US006910918B1

(12) United States Patent
Driver

(10) Patent No.: US 6,910,918 B1
(45) Date of Patent: Jun. 28, 2005

(54) LIGHT BULB MOUNTING ASSEMBLY

(76) Inventor: Jason W. Driver, 1718 Rosemeade Cir., Carrollton, TX (US) 75007

( * ) Notice: Subject to any disclaimer, the term of this patent is extended or adjusted under 35 U.S.C. 154(b) by 52 days.

(21) Appl. No.: 10/783,685

(22) Filed: Feb. 23, 2004

(51) Int. Cl.[7] ..... H01R 439/542
(52) U.S. Cl. ..... 439/542; 362/153.1
(58) Field of Search ..... 439/542, 413, 439/41, 412; 362/431, 353, 360, 152, 153.1, 362/249, 153, 396; 153/153; 396/396

(56) References Cited

U.S. PATENT DOCUMENTS 4,996,636 A * 2/1991 Lovett ..... 362/431
5,036,447 A 7/1991 Taylor
5,172,454 A * 12/1992 Martignago ..... 24/68 SK
5,280,417 A 1/1994 Hall et al.
5,398,180 A * 3/1995 Lee ..... 362/431
5,570,952 A 11/1996 Protz, Jr.
5,928,026 A * 7/1999 Hsu ..... 439/413
6,135,623 A * 10/2000 Lin ..... 362/431
6,398,391 B1 6/2002 Huang
D469,566 S 1/2003 Gary et al.

* cited by examiner

*Primary Examiner*—Ross Gushi
*Assistant Examiner*—Phuongchi Nguyen

(57) ABSTRACT

A light bulb mounting assembly includes a socket assembly that has a bottom wall and a peripheral wall that is attached to and extends upwardly from the bottom wall. The peripheral wall has an upper edge defining an opening extending into the socket. The opening has an inner threaded surface adapted for threadably coupling with a light bulb. The opening has a pair of electrical contacts therein. A power cord extends through the socket assembly and is electrically coupled to each of the electrical contacts. A male coupler is attached to a surface of the bottom wall and extends downwardly therefrom. A stake has a bottom end, a top end and a perimeter wall extending between the top and bottom ends. The bottom end is pointed and the top end is substantially flat. The top end has a female coupler extending therein for selectively coupling with the male coupler.

4 Claims, 6 Drawing Sheets

LIGHT BULB MOUNTING ASSEMBLY

BACKGROUND OF THE INVENTION

1. Field of the Invention

The present invention relates to light bulb mounting devices and more particularly pertains to a new light bulb mounting device for mounting a light bulb socket to a stake.

2. Description of the Prior Art

The use of light bulb mounting devices is known in the prior art. U.S. Pat. No. 5,570,952 describes a device for running a power cord through the top end of a stake for mounting a light socket, electrically coupled to the power cord, to the stake. Another type of light bulb mounting device is U.S. Pat. No. 6,398,391 having a housing into which the light socket is extended before the upper of a stake is then extended into an opposite end of the housing. In this manner, the socket is coupled to the stake. In yet another example, U.S. Pat. No. 5,036,447 includes a stack into which a particularly designed light socket clips so that the light socket is attached to the stake.

While these devices fulfill their respective, particular objectives and requirements, the need remains for a device that more efficiently, and securely, attaches a light socket to a stake. This is necessary for providing a user of the lights more freedom in determining if the lights are to hung on a vertical surface or tree, or if the lights should be positioned on a stake so that they are positioned generally adjacent to a ground surface.

SUMMARY OF THE INVENTION

The present invention meets the needs presented above by generally comprising a socket assembly that has a bottom wall and a peripheral wall that is attached to and extends upwardly from the bottom wall. The peripheral wall has an upper edge defining an opening extending into the socket. The opening has an inner threaded surface adapted for threadably coupling with a light bulb. The opening has a pair of electrical contacts therein. A power cord extends through the socket assembly and is electrically coupled to each of the electrical contacts. A male coupler is attached to a surface of the bottom wall and extends downwardly therefrom. A stake has a bottom end, a top end and a perimeter wall extending between the top and bottom ends. The bottom end is pointed and the top end is substantially flat. The top end has a female coupler extending therein for selectively coupling with the male coupler.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
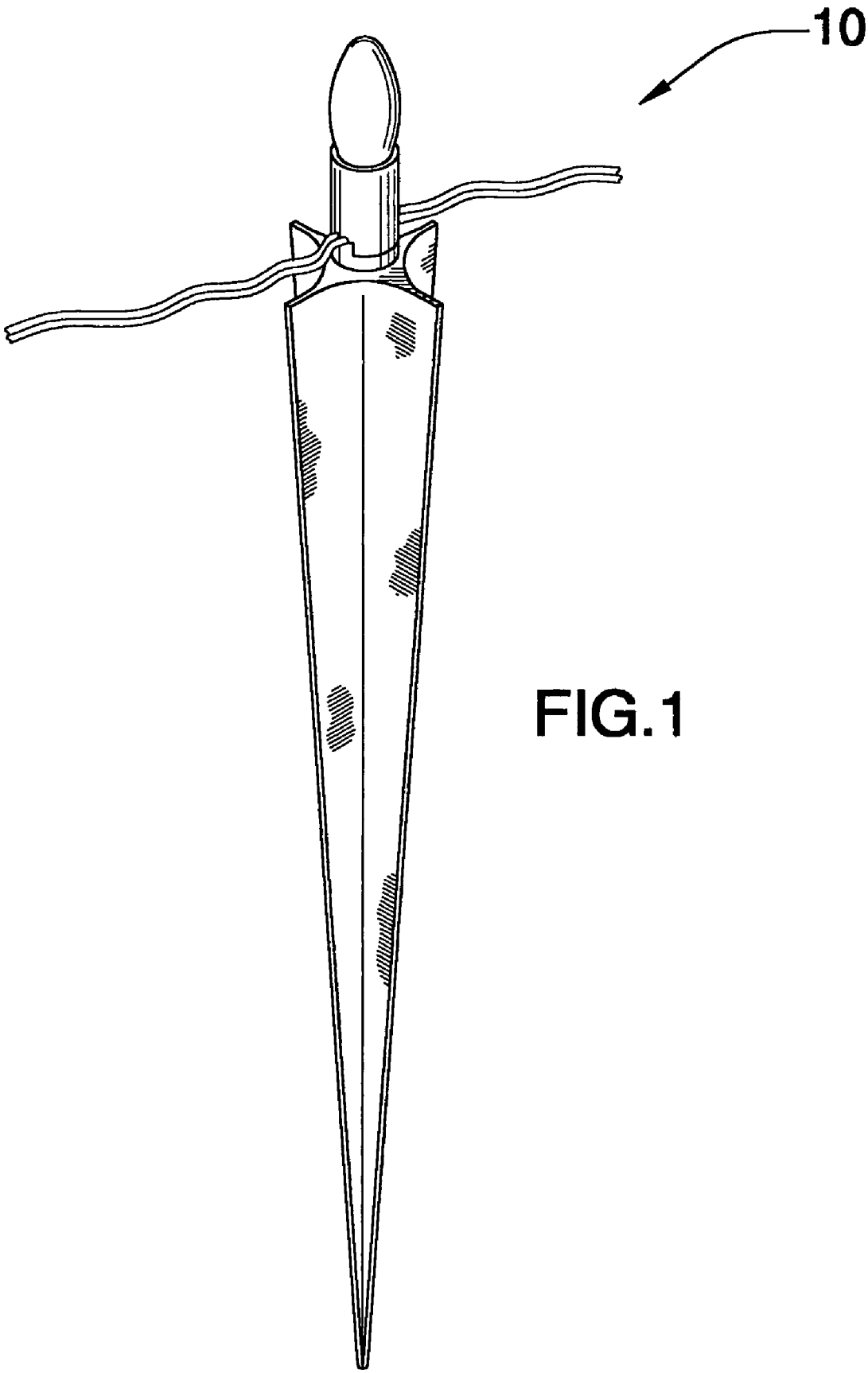
FIG. 1 is a perspective view of a light bulb mounting assembly according to the present invention.
Figure 2:
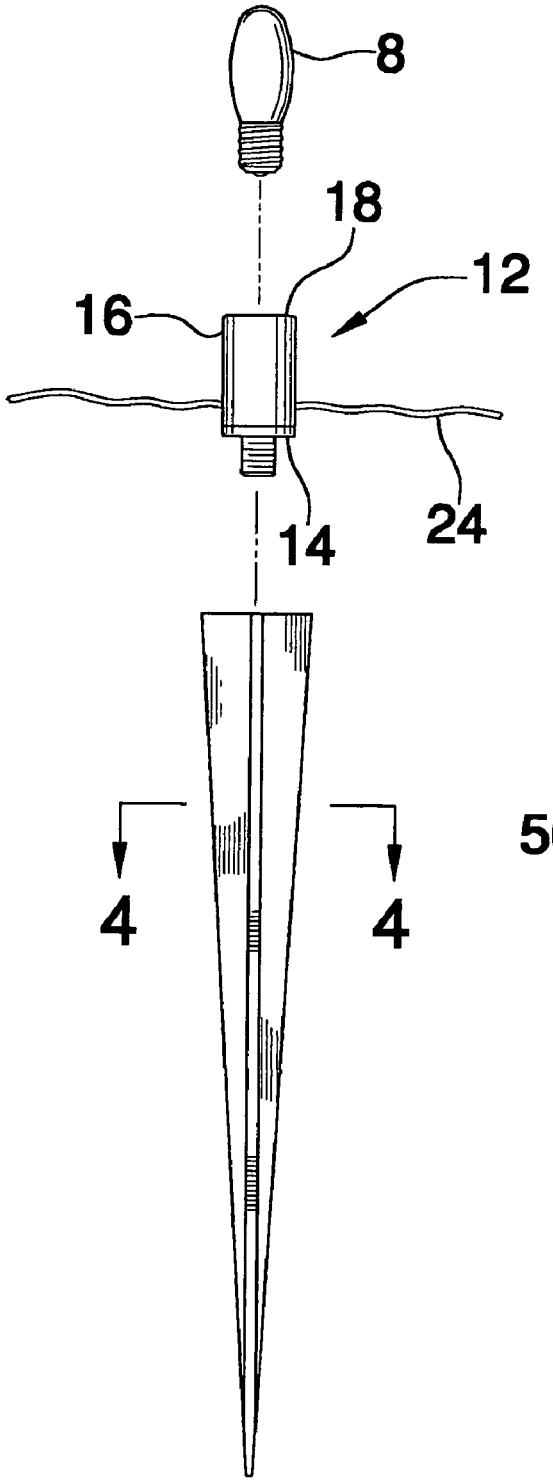
FIG. 2 is a side view of the present invention.
Figure 4:
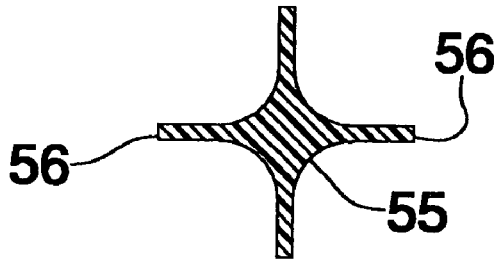
FIG. 4 is a cross-sectional view taken along line 4—4 of FIG. 2 of the present invention.
Figure 3:
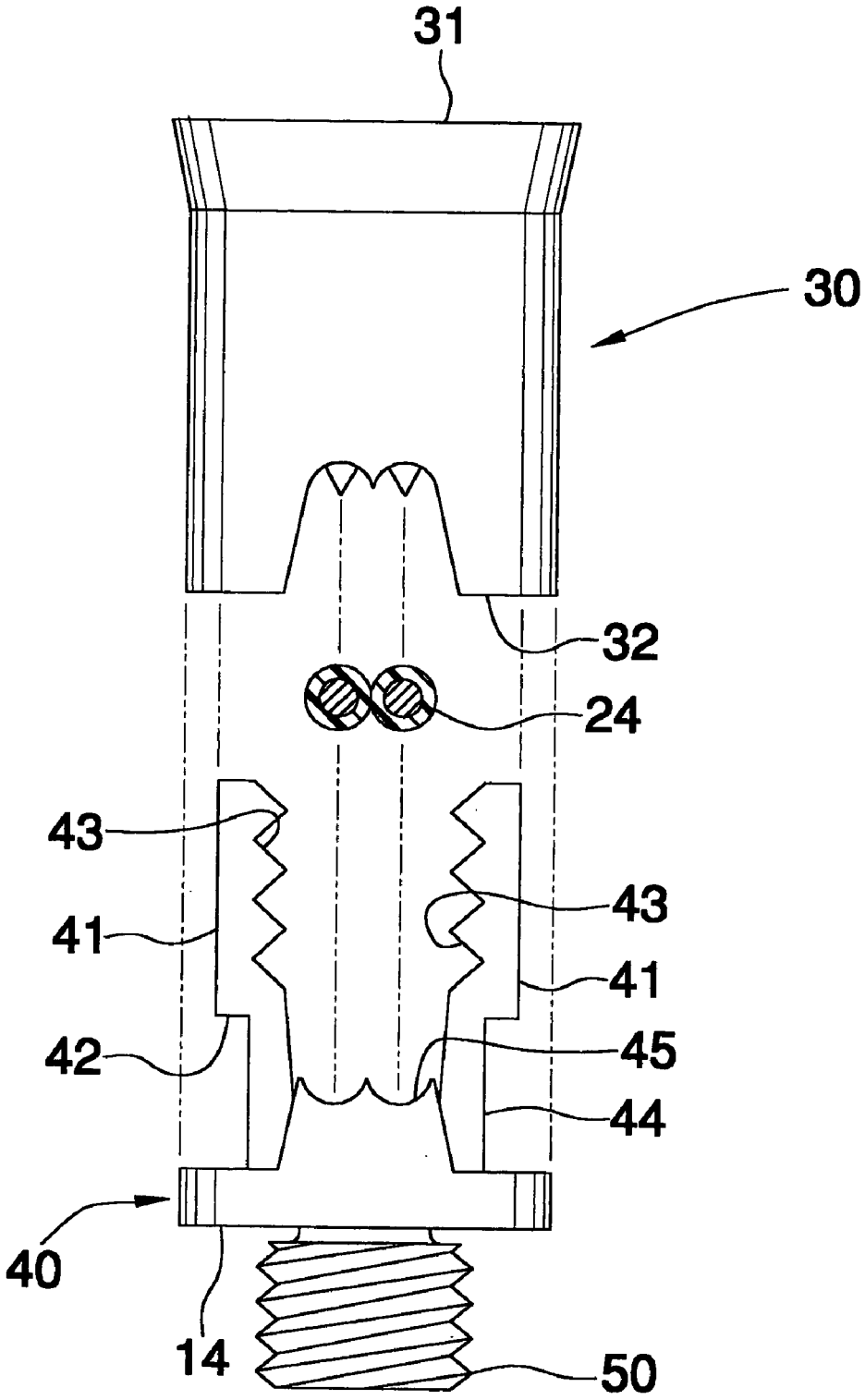
FIG. 3 is a side view of the socket assembly of the present invention.
Figure 5:
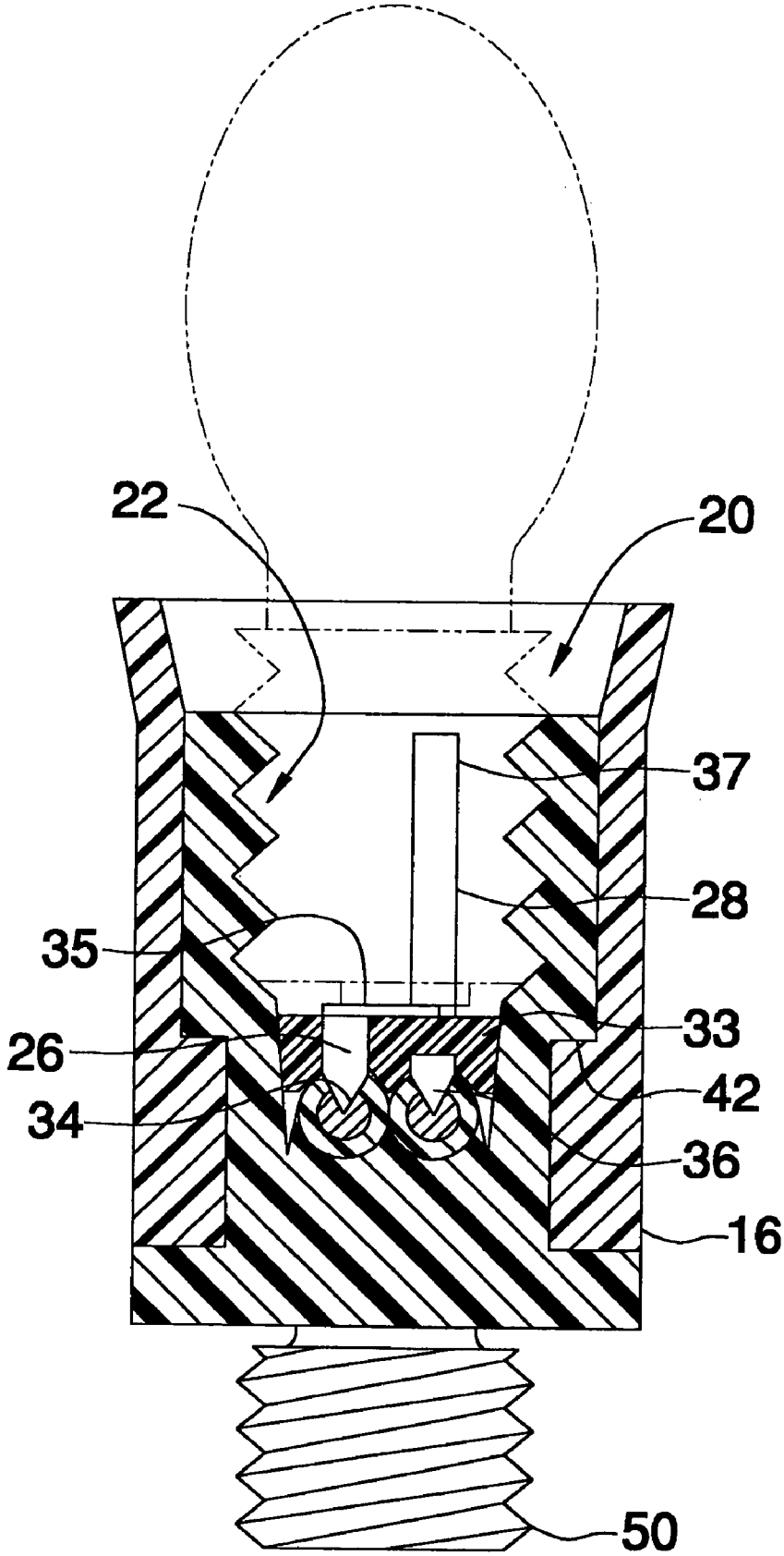
FIG. 5 is a cross-sectional view of the socket assembly of the present invention.
Figure 6:
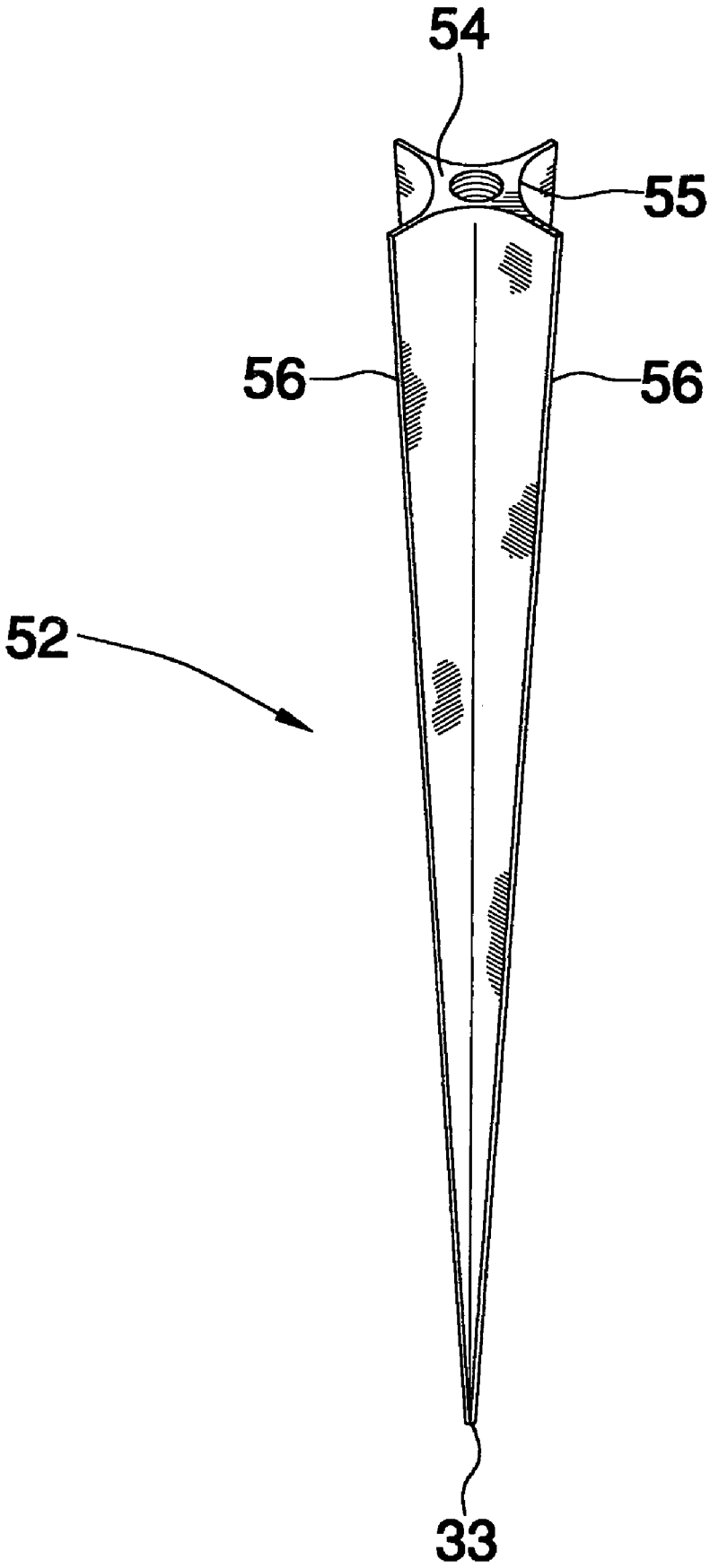
FIG. 6 is a perspective view of a stake of the present invention.
Figure 7:
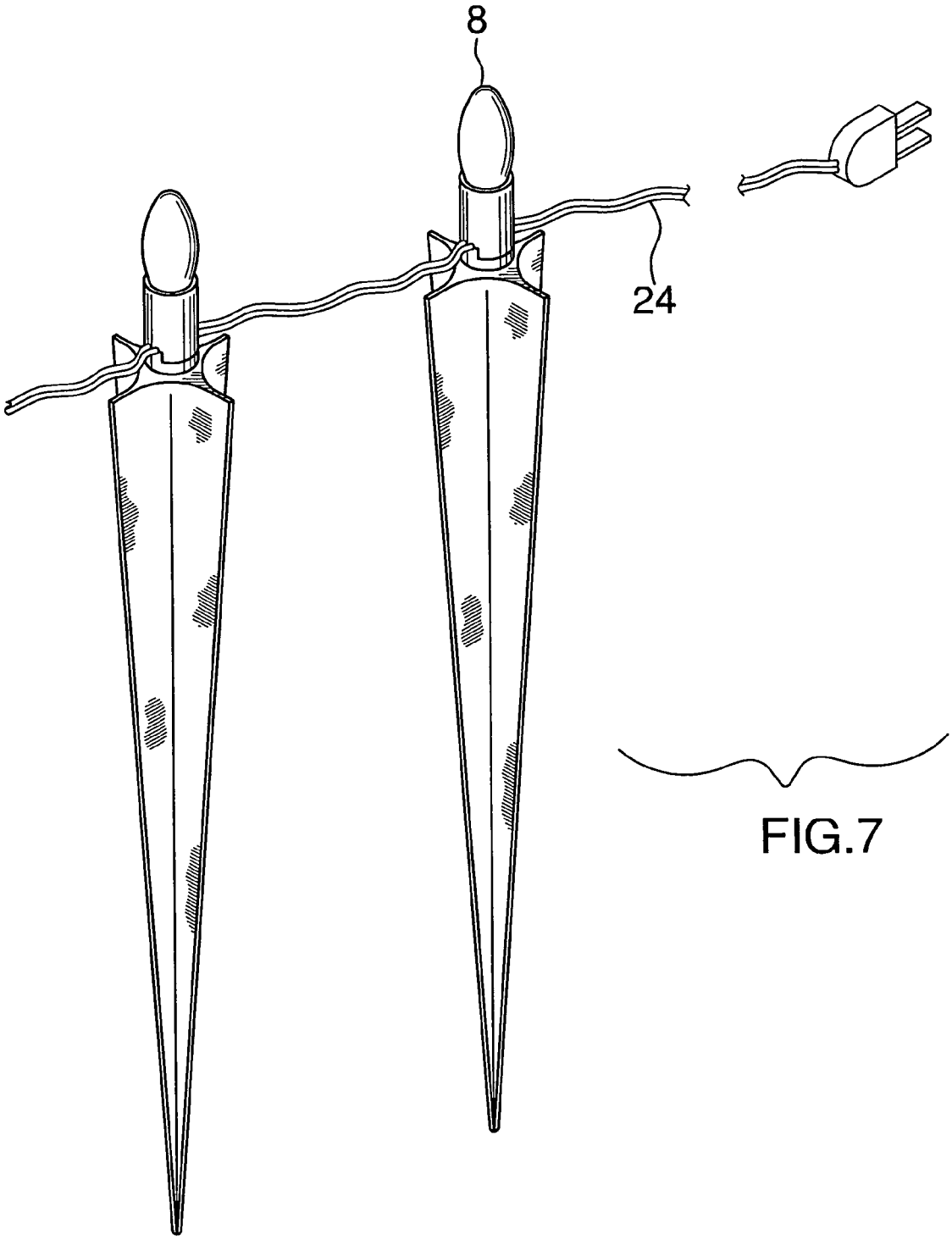
FIG. 7 is a schematic perspective view of the present invention.

With reference now to the drawings, and in particular to FIGS. 1 through 7 thereof, a new light bulb mounting device embodying the principles and concepts of the present invention and generally designated by the reference numeral 10 will be described.

As best illustrated in FIGS. 1 through 7, the light bulb mounting assembly 10 generally comprises a plurality of socket assemblies 12 that each have a bottom wall 14 and a peripheral wall 16 that is attached to and extends upwardly from the bottom wall 14. Each of the peripheral walls 16 of the socket assemblies 12 has an upper edge 18 defining an opening 20 extending into the socket. The openings 20 each have an inner threaded surface 22 adapted for threadably coupling with a light bulb 8. A power 24 cord extends through each of the socket assemblies 12. Each of the socket assemblies 12 has a pair of electrical contacts 26, 28 mounted within a corresponding one of the openings 20 and each of the electrical contacts 26, 28 is electrically coupled to the power cord 24.

In particular, it is preferred that each of the socket assemblies 12 includes an outer covering 30 having an upper open end 31 and a bottom open end 32. The peripheral wall 16 extends between the upper 31 and bottom 32 open ends. A bridge 33 is mounted in and extends across the covering 30. The bridge 33 is positioned nearer the bottom open end 32 than the top open end 31. A first contact 26 of the pair of contacts is mounted in the bridge 33 and has a first end 34 extending downwardly away from the bridge 33 and a second end 35 mounted on the bridge 33. A second contact 28 of the pair of contacts is mounted in the bridge 33 and has a first end 36 extending downwardly away from the bridge 33 and a second end 37 extending upwardly along an inner surface of the covering 30. Each of the first ends 34, 36 of the first 26 and second 28 contacts is preferably pointed and each extends into the power cord 24. A cap member 40 includes the bottom wall 14 and a pair of arms 41 extending upwardly from the bottom wall 14. The arms 41 may be extended upwardly through the bottom open end 32 on either side of the bridge 33 such that the arms 41 are removably secured in the covering 30. This may be done with interlocking shoulders 42. Each of the arms 41 has an inside surface 43 facing each other. The inside surfaces 43 are threaded for threadably coupling with the light bulb 8. A gripping 44, or aligning, member is attached to the bottom wall 14 and is positioned between the arms 41. The gripping member 44 has elongated channels 45 therein for receiving the power cord 24. The gripping member 44 biases the power cord 24 against the first ends 34, 36 of the first 26 and second 28 contacts so that the first ends 34, 36 puncture the power cord 24 and are thereby electrically coupled to the power cord 24.

Each of a plurality of male couplers 50 is attached to a surface of the bottom wall 16 and extends downwardly therefrom. Each of the male couplers 50 preferably comprises a threaded rod.

A plurality of stakes 52 has a bottom end 53, a top end 54 and a perimeter wall 55 extends between the top 54 and bottom ends 53. Each of the bottom ends 53 is pointed and each of the top ends 54 is substantially flat. Each of the top ends 54 has a female coupler 55 extending therein. The female couplers 55 each comprise a threaded well adapted for threadably coupling with one of the male couplers 50. A plurality of flanges 56 is attached to and extends outwardly from each of the perimeter walls 55. The flanges 56 each extend from and taper from a respective one of the top ends 54 to the bottom ends 53 such that each of the flanges 56 ends adjacent to the bottom ends 53. The plurality of flanges 56 is preferably four flanges 56 attached to each of the stakes 52.

In use, the above description may be used for one socket assembly 12 and one stake 52 or a plurality of sockets assemblies 12 and stakes. The male coupler 50 allows the socket assembly 12 to be selectively removed from the stakes 52 with minimal effort. Thus, if a person wishes to hang the lights 8, they may do so, or they may attach the socket assemblies 12 to the stakes 52 so that they may be staked into a ground surface. The socket assemblies 12 may be configured to hold any conventional light bulb, though it is preferred that low wattage holiday lights are utilized.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A light bulb socket and mounting combination comprising:

a socket assembly having a bottom wall and a peripheral wall being attached to and extending upwardly from said bottom wall, said peripheral wall having an upper edge defining an opening extending into said socket, said opening having an inner threaded surface adapted for threadably coupling with a light bulb, said opening having a pair of electrical contacts therein, a power cord extending through said socket assembly and being electrically coupled to each of said electrical contacts;

a male coupler being attached to a surface of said bottom wall and extending downwardly therefrom; and a stake having a bottom end, a top end and a perimeter wall extending between said top and bottom ends, said bottom end being pointed, said top end being substantially flat, said top end having a female coupler extending therein for selectively coupling with said male coupler a plurality of flanges being attached to and extending outwardly from said perimeter wall, each of said flanges extending from and tapers from said top end to said bottom end such that each of said flanges ends adjacent to said bottom end.

2. The combination of claim 1, wherein said socket assembly further includes:

an outer covering having an upper open end and a bottom open end, said peripheral wall extending between said upper and bottom open ends;

a bridge being mounted in and extending across said covering, said bridge being positioned nearer said bottom open end than said top open end;

a first contact of said pair of contacts being mounted in said bridge and having a first end extending downwardly away from said bridge and a second end mounted on said bridge;

a second contact of said pair of contacts being mounted in said bridge and having a first end extending downwardly away from said bridge and a second end extending upwardly along an inner surface of said covering, each of said first ends of said first and second contacts extending into said power cord;

a cap member including said bottom wall and a pair of arms extending upwardly from said bottom wall, wherein said arms may be extended upwardly through said bottom open end on either side of said bridge such that said arms are removably secured in said covering, each of said arms having an inside surface facing each other, each of said inside surfaces being threaded for threadably coupling with the light bulb; and a gripping member being attached to said bottom wall and being positioned between said arms, said gripping member having elongated channels therein for receiving said power cord, wherein said gripping member biases said power cord against said first ends of said first and second contacts such that said first ends puncture said power cord.

3. The combination of claim 1, wherein said male coupler comprises a threaded rod and said female coupler comprises a threaded aperture adapted for threadably coupling said threaded rod.

4. A light bulb socket and mounting combination comprising:

a plurality of socket assemblies each having a bottom wall and a peripheral wall being attached to and extending upwardly from said bottom wall, each of said peripheral walls having an upper edge defining an opening extending into said socket, each of said openings having an inner threaded surface adapted for threadably coupling with a light bulb, a power cord extending through each of said socket assemblies, each of said socket assemblies having a pair of electrical contacts mounted within a corresponding one of said openings, each of said electrical contacts being electrically coupled to said power cord;

a plurality of male couplers, each of said male couplers being attached to a surface of said bottom wall and extending downwardly therefrom, each of said male couplers comprising a threaded rod; and a plurality of stakes, each of said stakes having a bottom end, a top end and a perimeter wall extending between said top and bottom ends, each of said bottom ends being pointed, each of said top ends being substantially flat, each of said top ends having a female coupler extending therein, each of said female couplers comprising a threaded well adapted for threadably coupling with one of said male couplers, a plurality of flanges being attached to and extending outwardly from each of said perimeter walls, each of said flanges extending from and tapering from a respective one of said top ends to said bottom ends such that each of said flanges ends adjacent to said bottom ends, said plurality of flanges being four flanges attached to each of said stakes.

* * * * *